US010352338B2

(12) United States Patent
Hahn et al.

(10) Patent No.: US 10,352,338 B2
(45) Date of Patent: Jul. 16, 2019

(54) DEVICE FOR RECUPERATION OF HYDRAULIC ENERGY AND WORKING MACHINE WITH CORRESPONDING DEVICE

(71) Applicant: Liebherr-Mining Equipment Colmar SAS, Colmar (FR)

(72) Inventors: Philipp Hahn, Turckheim (FR); Volker Gliniorz, Breisach am Rhein (DE); Guillaume Bonnetot, Zimmersheim (FR)

(73) Assignee: Liebherr-Mining Equipment Colmar SAS, Colmar (FR)

( * ) Notice: Subject to any disclaimer, the term of this patent is extended or adjusted under 35 U.S.C. 154(b) by 119 days.

(21) Appl. No.: 15/439,157

(22) Filed: Feb. 22, 2017

(65) Prior Publication Data

US 2017/0241454 A1 Aug. 24, 2017

(30) Foreign Application Priority Data

Feb. 23, 2016 (DE) ..... 10 2016 002 134

(51) Int. Cl.

| | |
|---|---|
| ***F15B 21/14*** | (2006.01) |
| ***F15B 1/027*** | (2006.01) |
| ***F15B 11/10*** | (2006.01) |
| ***F15B 1/02*** | (2006.01) |
| ***E02F 9/22*** | (2006.01) |

(52) U.S. Cl.

CPC ..... *F15B 21/14* (2013.01); *E02F 9/2217* (2013.01); *F15B 1/024* (2013.01); *F15B 1/027* (2013.01); *F15B 11/10* (2013.01); *F15B 2201/31* (2013.01); *F15B 2201/3151* (2013.01); *F15B 2201/3152* (2013.01); *F15B 2211/20507* (2013.01); *F15B 2211/212* (2013.01); *F15B 2211/3058* (2013.01); *F15B 2211/7053* (2013.01)

(58) Field of Classification Search

CPC ..... F15B 1/024; F15B 1/027; F15B 21/14; F15B 2211/212; F15B 2211/3058

See application file for complete search history.

(56) References Cited

U.S. PATENT DOCUMENTS

| | | | | |
|---|---|---|---|---|
| 7,259,944 | B2 * | 8/2007 | Branston | H01H 9/42 361/2 |
| 7,269,944 | B2 * | 9/2007 | Zhang | E02F 9/2217 60/414 |
| 7,634,911 | B2 * | 12/2009 | Brinkman | E02F 9/2075 60/414 |
| 7,775,040 | B2 * | 8/2010 | Khalil | F15B 11/024 60/414 |
| 7,891,181 | B2 * | 2/2011 | Baltes | B66F 9/22 60/414 |
| 8,726,645 | B2 * | 5/2014 | Shang | E02F 9/123 60/414 |
| 9,021,798 | B2 * | 5/2015 | Sipola | F15B 11/036 60/428 |

(Continued)

FOREIGN PATENT DOCUMENTS

DE 198 29 679 A1 1/2000

*Primary Examiner* — Thomas E Lazo

(74) *Attorney, Agent, or Firm* — Dilworth & Barrese, LLP

(57) ABSTRACT

This invention relates to a device for the recuperation of hydraulic energy in a working machine with at least one differential cylinder and to a corresponding working machine.

14 Claims, 1 Drawing Sheet

(56) References Cited

U.S. PATENT DOCUMENTS

| | | | | |
|---|---|---|---|---|
| 9,127,736 | B2 * | 9/2015 | Lavergne | E02F 3/425 |
| 9,151,018 | B2 * | 10/2015 | Knussman | E02F 9/2217 |
| 2008/0104955 | A1 | 5/2008 | Khalil | |
| 2015/0308079 | A1 * | 10/2015 | Vigholm | F15B 21/14 180/14.1 |

* cited by examiner

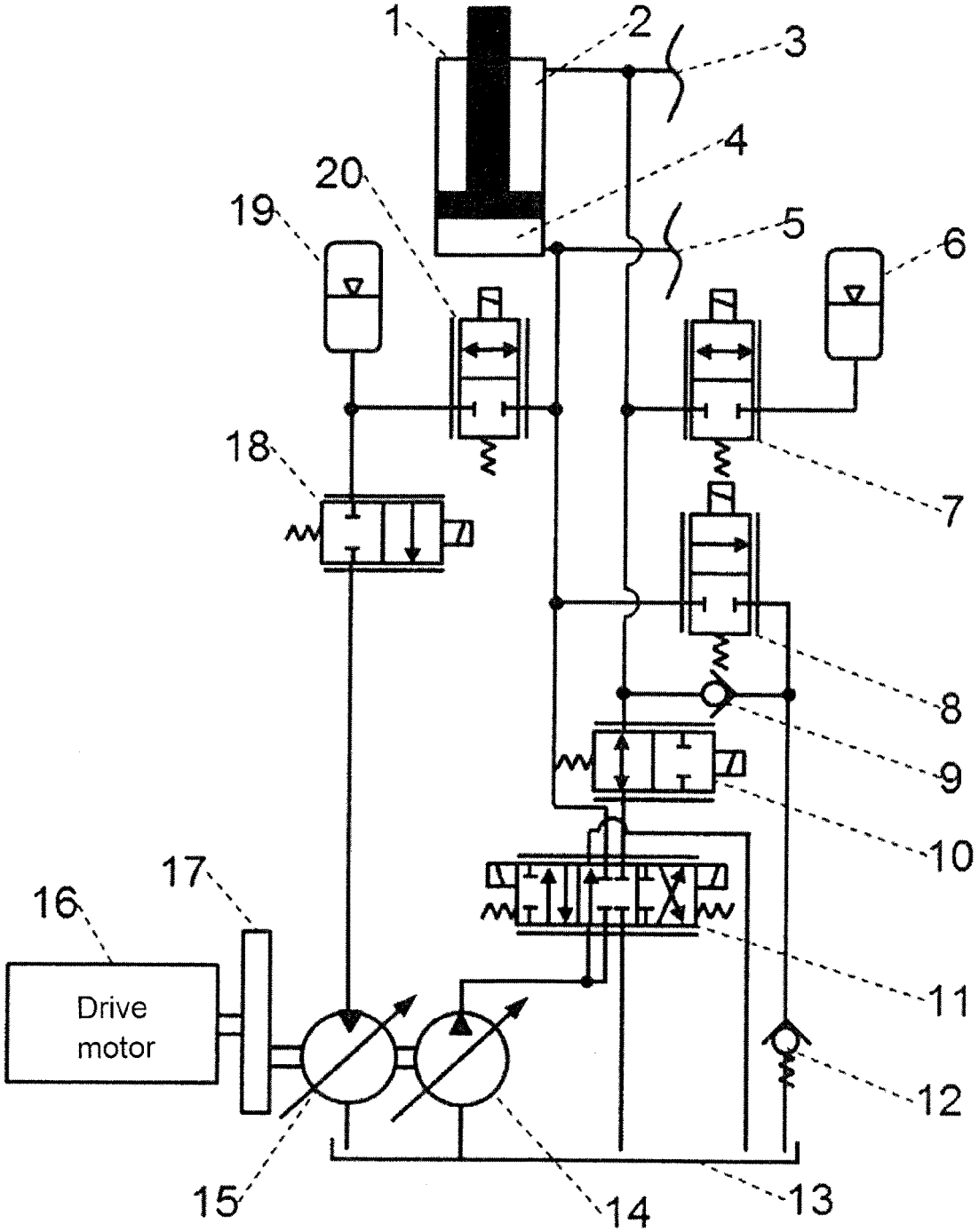
1
2
3
4
5
6
7
8
9
10
11
12
13
14
15
16
17
18
19
20
Drive motor

DEVICE FOR RECUPERATION OF HYDRAULIC ENERGY AND WORKING MACHINE WITH CORRESPONDING DEVICE

BACKGROUND OF THE INVENTION

This invention relates to a device for the recuperation of hydraulic energy and to a working machine with a corresponding device.

In the known interconnections of hydraulic cylinders in mobile working machines the retraction of hydraulic cylinders under pressing load (e.g. stroke of lowering without pressure) is realized by a throttle control. The potential energy which is defined by the load on the cylinder here is converted into heat by throttling the volume flow under pressure. Due to this process, the existing potential energy is destroyed. Due to the conversion into heat, additional cooling capacity furthermore must disadvantageously be applied within the machine.

A commonly used type of the hydraulic cylinders in mobile working machines is the differential cylinder. When the same is retracted by means of a throttle control and under pressing load, it must be ensured that refilling of the rod-side cylinder chamber is ensured. This is possible with the addition of a corresponding supply volume flow by the working pumps. Alternatively or in addition, a corresponding refilling of the rod-side cylinder chambers can be carried out by a recirculation of the throttled volume flow. By recirculating the throttled volume flow, a division of the volume flow corresponding to the area ratio of the hydraulic cylinders and corresponding to the volume ratio of the chambers of the hydraulic cylinder is made. A part of the volume flow here flows into the rod-side chambers of the cylinders and the other part is passed into the tank.

When the potential energy released during the lowering operation of the hoisting cylinders is to be stored, there is an interest in storing as much as possible of the existing energy. In hydraulics, this corresponds to the greatest possible volume flows under the highest possible pressure. The known hydraulic interconnections, which realize the recirculation of a part of the bottom-side volume flow into the rod-side chambers of the hydraulic cylinders, reduce the volume flow that can be available for storage.

At present, different solutions exist for the storage of the potential energy on lowering the boom of mobile hydraulic working machines.

The document US 2013/0081383 describes a solution in which one of two cylinders is used for storing energy. There is used a displacement machine in closed circuit, in order to refill the rod-side chambers of both cylinders with the return flow quantity of the second cylinder. A disadvantage of the invention described here is the non-existing exchange of oil on the bottom side of the hydraulic cylinder which is connected with the accumulator. The oil volume only is moved between hydraulic accumulator and bottom side of the cylinder.

Within an interconnection of document DE 10 2012 009 668 a hydraulic pump is utilized on retraction of the cylinders, in order to ensure refilling of the rod-side chambers. Refilling by application of hydraulic power does not correspond to an energy-efficient actuation of the hydraulic consumers.

What also is possible is the take-up of the potential energy of the boom by a gas-filled cylinder (DE 10 2010 051 665). In accordance with this invention the additional integration of a gas cylinder into the machine is necessary, which means a high integration expenditure.

At present, different possibilities exist for feeding in the stored hydraulic energy. The document WO 2013/180605 describes the direct feeding into the fan circuit of the machine. Based on the operating point of the fan circuit it is necessary to throttle the supplied volume flow from the hydraulic accumulator to the fan circuit. There are caused throttling losses and the amount of the reusable hydraulic energy thus is reduced.

It furthermore is possible to use the stored hydraulic energy directly for supplying the working pumps. This is described in the document DE 10 2005 052 108. There is required a circuitry which connects the suction side of the working pump either with the hydraulic tank or with the hydraulic accumulator. When the pump is not supplied via the hydraulic accumulator, pressure losses occur through the valve, which influence the intake pressure of the pump and thus can cause unfavorable operating conditions. In addition cooling and filtering must be provided between hydraulic accumulator and intake.

The known hydraulic interconnections correspondingly can have the following disadvantages:

1. The potential energy of the lifting-lowering operation is destroyed by the throttling operation and cannot be used for other processes.
2. The potential energy of the lifting-lowering operation is introduced into the hydraulic system in the form of thermal energy and must subsequently be discharged again by corresponding cooling devices. These processes likewise are consuming energy.
3. The division of the bottom-side volume flow on lowering of the hoisting cylinders leads to a reduction of the possible potential of storable energy.

SUMMARY OF THE INVENTION

In view of these problems it is the object of the invention to store the potential energy, which is defined by the pressing load on the hydraulic cylinders or on the hydraulic cylinder, and possibly ensure energy-efficient refilling of the rod-side chambers of the hydraulic cylinders. The quantity of the storable potential energy thereby is maximized, which energy can be used for other tasks within the working machine. Furthermore, the cooling capacity expended can be reduced, as due to the cooling system within the machine less lost heat must be dissipated. Based thereon, the entire operation of the hydraulic working machine can be designed more energy-efficient.

According to the invention, this object is solved by a device for the recuperation of hydraulic energy in a working machine with at least one differential cylinder with the features herein and by a working machine with the features herein. Advantageous aspects of the invention are subject-matter of the description herein.

Accordingly, there is provided a device with at least one storage device comprising at least one high-pressure accumulator and at least one low-pressure accumulator for energy storage of the potential energy of the at least one differential cylinder retracting under pressing load.

It can preferably be provided that the device comprises at least one regenerating interconnection for recirculating hydraulic fluid into the rod side of the differential cylinder, wherein the regenerating interconnection and the storage device in particular are arranged parallel to each other, and/or that the accumulators each are coupled with the differential cylinder via merely one valve and corresponding lines.

For the energy storage (storage circuitry) the provision of two accumulators with different pressure levels is necessary. In operation of the storage system the oil under high pressure, which escapes from the bottom side of the differential cylinder, is stored in the high-pressure accumulator. Due to the retraction of the cylinder, oil must be refilled on the rod side. This is effected via the oil volume from the low-pressure accumulator. The two accumulators (high-pressure and low-pressure accumulator) are in parallel operation during the storage operation.

In a further advantageous aspect it is conceivable that by means of the regenerating interconnection hydraulic fluid from the hydraulic accumulator and/or from the bottom side of the differential cylinder flows into its rod side. The term of the recuperation device or recuperating interconnection can be related to the storage of energy in the accumulators. The term of the regenerating interconnection especially describes the recirculation of hydraulic fluid into the rod side of the differential cylinder.

In a further advantageous aspect it is conceivable that the throttled hydraulic fluid flows into the rod side and/or that the recuperation of energy is effected on the entire path of retraction or only on a part of the path of retraction of the differential cylinder. By throttling the hydraulic fluid it is possible to adapt for example hydraulic fluid from the bottom side of the differential cylinder to the pressure conditions of the rod side of the differential cylinder and thus pass it in adapted form from the bottom into the rod side. In general, throttling provides for supplying hydraulic fluid from the bottom side of the differential cylinder into the rod side of the differential cylinder.

In a further advantageous aspect it is conceivable that a support motor connected with the high-pressure accumulator is provided for feeding energy into the drive train of the working machine. Independent of the further usual devices of the working machine an energy recuperation can be effected by means of the support motor, which thereby converts pressure energy into kinetic energy that can be supplied to other peripheral devices of the working machine.

In a further advantageous aspect it can be provided that the support motor is designed as proportionally adjustable motor, as switchingly adjustable motor or as motor with constant absorption volume and/or that the hydraulic accumulator is designed as bladder accumulator, piston accumulator, membrane accumulator or as spring accumulator.

The invention also is directed to a working machine, in particular to an excavator with a device according to the description herein, wherein it can be provided in particular that the device is not required for the normal operation of the working machine. As an add-on solution, the device also can subsequently be coupled with the otherwise fully operable working machine.

BRIEF DESCRIPTION OF THE DRAWING

Further details and advantages of the invention are shown in the exemplary representation of the only FIGURE:

FIG. 1 shows the schematic hydraulic circuit of an exemplary embodiment of the invention described here. The exemplary embodiment is characterized in that one or more differential cylinders 1 can be retracted under pressing load and the existing potential energy can be stored in the process for a large part by means of at least two hydraulic accumulators.

DESCRIPTION OF THE PREFERRED EMBODIMENT

The exemplary embodiment furthermore is characterized in that one or more differential cylinders 1 can be retracted under pressing load and filling of the rod sides 2 of the cylinders 1 is carried out very energy-efficiently. This is achieved in that during retraction one or more low-pressure accumulators 6 can be connected with the rod sides 2 of the differential cylinders 1.

The exemplary embodiment furthermore is characterized in that one or more differential cylinders 1 can be retracted under pressing load, without the hydraulic accumulators 6, 19 and hydraulic valves being activated for the storage of potential energy or for supplying the rod sides. This is achieved in that the hydraulic circuit shown is provided with a regenerating interconnection which throttles the bottom-side oil volume flow and supplies the corresponding oil volume flow to the rod sides 2.

The exemplary embodiment furthermore is characterized in that by combining the interconnection of the differential cylinders 1 with the hydraulic accumulators 6, 19 for energy storage, for supplying the rod sides 2 and for the regenerating interconnection it is possible to perform the energy storage operation only on a part of the path of retraction of the differential cylinders 1 under pressing load.

The exemplary embodiment also is characterized in that the stored energy of the lowering operation of the one differential cylinder 1 or of several differential cylinders 1 can be reused. This is achieved in that a hydraulic motor 15 or support motor 15 can be connected with the corresponding high-pressure accumulator 19 and the energy contained in the high-pressure accumulator 19 can be fed into the drive train of the machine to support the primary drive source (Diesel engine or electric motor 16).

The exemplary embodiment also is characterized in that it can be integrated into the drive train of a machine without influencing the functions of the drive train such that the complete operability of the machine depends on the invention. This means that the machine also can be operated properly without the operability of the invention.

When taking the machine into operation, the respective preload pressures exist in the high-pressure accumulator 19 and low-pressure accumulator 6. Before the first storage operation can be started, the upper working pressure of the low-pressure accumulator 6 must exist in the low-pressure accumulator 6, which is achieved by a corresponding supply of oil quantity into the low-pressure accumulator 6. For this purpose, the differential cylinder 1 can be extended. This is effected by producing a volume flow with the working pump 14 and by a corresponding actuation of the control slide 11. During this movement the retaining valve 10 is closed and the entire exiting volume flow from the rod side 2 of the differential cylinder 1 is passed through the low-pressure accumulator valve 7 into the low-pressure accumulator 6. When the upper operating pressure of the low-pressure accumulator 6 is reached, the retaining valve 10 is opened and the low-pressure accumulator valve 7 is closed. The exiting volume flow from the rod side 2 of the differential cylinder 1 now is guided back into the tank 13 via the control slide 11.

When the storage operation is to be started, an external force must be applied on the differential cylinder 1, which leads to the retraction of the cylinder 1. A pressure thereby is built up on the bottom side 4 of the differential cylinder 1, which defines the existing potential energy. This potential energy is to be absorbed by the high-pressure accumulator 19. By the proportionally adjustable hydraulic high-pressure accumulator valve 20 a connection is created between the bottom side 4 of the differential cylinder 1 and the high-pressure accumulator 19. By the proportionally adjustable hydraulic low-pressure accumulator valve 7 a connection is created between the rod side 2 of the differential cylinder 1 and the low-pressure accumulator 6. By the proportional adjustment of the high-pressure accumulator valve 20 the speed of retraction of the differential cylinder 1 can be adjusted. During the retracting movement of the differential cylinder 1 the exiting volume flow of the bottom side 4 of the differential cylinder 1 is passed through the high-pressure accumulator valve 20 into the high-pressure accumulator 19, where it leads to an increase in pressure. Due to the retracting movement of the differential cylinder 1 the volume of the rod-side chamber 2 of the differential cylinder 1 is increased. Refilling of the necessary oil quantity becomes possible via the low-pressure accumulator valve 7 from the low-pressure accumulator 6.

When the retracting movement of the differential cylinder 1 is stopped, the high-pressure accumulator valve 20 and the low-pressure accumulator valve 7 are closed. The high-pressure accumulator 19 now contains the oil volume under pressure, which during the retracting movement of the differential cylinder 1 has been displaced from the bottom side 4 of the differential cylinder 1.

Upon completion of the storage operation the working pressure in the low-pressure accumulator 6 has decreased, as corresponding oil volume has been passed from the low-pressure accumulator 6 via the low-pressure accumulator valve 7 into the rod side 2 of the differential cylinder 1.

When in the working cycle of the machine an extending movement of the differential cylinder 1 follows by means of a corresponding actuation of the working pump 14 and the control slide 11, the retaining valve 10 is closed and the entire exiting volume flow from the rod side 2 of the differential cylinder 1 is passed through the low-pressure accumulator valve 7 into the low-pressure accumulator 6. When the upper operating pressure of the low-pressure accumulator 6 is reached, the retaining valve 10 is opened and the low-pressure accumulator valve 7 is closed. The exiting volume flow from the rod side 2 of the differential cylinder 1 now is guided back into the tank 13 via the control slide 11.

Depending on the size of the low-pressure accumulator 6 and the high-pressure accumulator 19, a storage of the potential energy on the entire or also on a part of the stroke of the differential cylinder 1 is possible. When the hydraulic accumulators 6 and 19 are designed only for a part of the stroke of the differential cylinder 1 and the retracting movement of the differential cylinder 1 is to be effected farther than permitted by the design of the hydraulic accumulators 6 and 19, a regenerating interconnection is used. The same includes the brake valve 8 which is connected with the bottom side 4 of the differential cylinder 1, the check valve 9 and the pre-loading valve 12. By proportional actuation of the brake valve 8, the volume flow is passed from the bottom-side chamber 4 of the differential cylinder 1 via the check valve 9 into the rod-side chamber 2 of the differential cylinder 1. At adjustable preload pressure, the excess oil quantity from the bottom side 4 of the differential cylinder 1 is passed into the tank 13 via the pre-loading valve 12. The regenerating interconnection hence ensures that the retraction of the differential cylinder 1 also is possible when there is a defect at the high-pressure accumulator 19 and/or low-pressure accumulator 6 or the low-pressure accumulator 6 has not yet been pre-loaded to its upper working pressure after putting the machine into operation.

After the storage operation, the energy of the oil volume under pressure in the high-pressure accumulator 19 can again be fed into the drive train of the machine. For this purpose, the support motor 15 is connected with the high-pressure accumulator 19 via the hydraulic support motor valve 18. The support motor 15 can be mounted directly on the transfer gear 17 of the machine and be operated with a speed given by the drive motor 16. Depending on the absorption volume of the support motor 15, energy then is fed into the drive train of the machine corresponding to the operating conditions of the high-pressure accumulator 19. Upon completion of the feeding operation, the support motor valve 18 is closed and the connection between high-pressure accumulator 19 and support motor 15 thus is separated.

When in the cycle of the machine a retracting movement of the differential cylinder 1 is to be effected, during which the volume flow of the working pump 14 is to be passed to the rod side 2 of the differential cylinder 1 by a corresponding actuation of the control slide 11, the low-pressure accumulator valve 7 is kept closed and the retaining valve 10 is kept open.

The cycle includes at least one working pump and at least one control slide.

As hydraulic accumulator all kinds of hydraulic accumulators can be used. Designs as bladder accumulator, piston accumulator, membrane accumulator or spring accumulator are conceivable.

Likewise, the invention is not limited to one kind of energy storage medium. In bladder and piston accumulators there is mostly used nitrogen or nitrogen mixtures.

For the construction of this invention there can also be used combinations of different types of accumulator.

The valves shown are usable as individual 2/2-way valves or also as combination on a valve rod. A proportional or switching actuation also is possible here.

The support motor can be employed as a design with proportionally adjustable, switchingly adjustable or also constant absorption volume.

The support motor 15, as shown, can be arranged directly on the transfer gear of the machine. It furthermore is conceivable that the support motor 15 is mounted on other rotating units and directly on the drive motor.

1. hoisting cylinder
2. cylinder chamber rod side
3. connection rod side hoisting cylinder
4. cylinder chamber bottom side
5. connection bottom side hoisting cylinder
6. low-pressure accumulator
7. low-pressure accumulator valve
8. brake valve
9. check valve
10. retaining valve
11. control slide
12. pre-loading valve
13. tank
14. working pump
15. support motor
16. drive motor
17. transfer gear

18. support motor valve

19. high-pressure accumulator

20. high-pressure accumulator valve

The invention claimed is:

1. A device for recovering hydraulic energy in a working machine having a differential cylinder (1) in turn containing a piston rod defining respective rod (2) and bottom (4) sides within the cylinder (1), said device comprising a high-pressure accumulator (19) coupled to the bottom side (4) of the cylinder (1), a low-pressure accumulator (6) coupled to the rod side (2) of the cylinder (1), only one valve which is a high-pressure accumulator valve (20) coupled directly between the high-pressure accumulator (19) and bottom side (4) of the cylinder (1), only one valve which is a low-pressure accumulator valve (7) coupled directly between the low-pressure accumulator (6) and rod side (2) of the cylinder (1), a tank (13), a control slide (11) coupled to the tank (13), and a retaining valve (10) coupled between the low-pressure accumulator valve (7) and control slide (11), such that when filling the low-pressure accumulator (6) with fluid from the rod side (2) of the cylinder (1), the low-pressure accumulator valve (7) is opened and the retaining valve (10) is closed, and when an upper operating pressure within the low-pressure accumulator (6) is reached, the retaining valve (10) is opened and the low-pressure accumulator valve (7) is closed, and the fluid is guided into the tank (13) through the control slide (11).

2. The device according to claim 1, wherein the device comprises at least one regenerating interconnection for recirculating hydraulic fluid into the rod side (2) of the differential cylinder, the regenerating interconnection and the storage device are arranged parallel to each other.

3. The device according to claim 2, wherein by the regenerating interconnection, hydraulic fluid flows from the low-pressure accumulator (6) and/or the bottom side (4) of the differential cylinder (1) into its rod side (2).

4. The device according to claim 2, wherein the throttled hydraulic fluid flows into the rod side (2).

5. The device according to claim 1, wherein the energy recuperation is effected on the entire path of retraction or only a part of the path of retraction of the differential cylinder (1).

6. The device according to claim 1, wherein a support motor (15) connected with the high-pressure accumulator (19) is provided for feeding energy into the drive train of the working machine.

7. The device according to claim 6, wherein the support motor (15) is designed as a proportionally adjustable motor, switchingly adjustable motor or motor with constant absorption volume.

8. The device according to claim 1, wherein the hydraulic accumulator (6, 19) is designed as bladder accumulator, piston accumulator, membrane accumulator or as spring accumulator.

9. The working machine according to claim 8, wherein the device is not required for the normal operation of the working machine.

10. A working machine, in particular an excavator, with a device according to claim 1.

11. The device according to claim 1, additionally comprising a brake valve (8) connected to the bottom side (4) of the cylinder (1), a check valve (9) coupled in parallel with the brake valve (8), and a pre-loading valve (12) coupled with the tank (13) and in series with both the brake valve (8) and the check valve (9), such that by proportional actuation of the brake valve (8), fluid flows from the bottom side (4) of the cylinder (1) through the check valve (9) and into the rod side (2) of the cylinder (1) and excess fluid flows from the bottom side (4) of the cylinder (1) and into the tank (3) through the pre-loading valve (12).

12. The device of claim 11, additionally comprising a support motor (15) and a support motor valve (18) directly connecting the high-pressure accumulator (19) and the support motor (15).

13. The device of claim 12, additionally comprising a working pump (14) coupled between the tank (13) and control slide (11).

14. The device of claim 13, additionally comprising a drive motor (16) having a transfer gear (17) on which both the support motor (15) and working pump (14) are rotatably mounted.

* * * * *